United States Patent [19]

Gasiunas et al.

[11] Patent Number: 4,846,715

[45] Date of Patent: Jul. 11, 1989

[54] POSTAGE METER VOICE COIL MOTOR PRINTWHEEL SETTING ASSEMBLY

[75] Inventors: Donatas V. Gasiunas, Carmel, N.Y.; Paul R. Sette, Hamden; Anthony Storace, Norwalk, both of Conn.

[73] Assignee: Pitney Bowes Inc., Stamford, Conn.

[21] Appl. No.: 136,086

[22] Filed: Dec. 21, 1987

[51] Int. Cl.[4] ..... B41J 7/32; B41J 7/34

[52] U.S. Cl. ..... 400/163.1; 400/155; 101/110; 335/231; 74/99 A; 74/104; 74/108; 235/142

[58] Field of Search ..... 235/142, 144 ME, 144 PN; 335/230, 231, 234, 112; 101/91, 110; 400/155, 163.1, 144, 144.1, 154.1, 162, 161.1, 164.2, 164.5; 74/99 A, 578, 104, 107, 108

[56] References Cited

U.S. PATENT DOCUMENTS

| | | | |
|---|---|---|---|
| 2,868,026 | 1/1959 | Finehart et al. | 74/578 |
| 3,677,452 | 7/1972 | Wallace | 400/573.1 |
| 4,164,181 | 8/1979 | Hanaoka | 101/110 |
| 4,244,290 | 1/1981 | Tamai et al. | 335/234 |
| 4,257,283 | 3/1981 | Haller et al. | 74/578 |
| 4,257,324 | 3/1981 | Stefansson et al. | 101/110 |
| 4,259,653 | 3/1981 | McGonigal | 335/230 |
| 4,668,928 | 5/1987 | Davis et al. | 335/234 |

FOREIGN PATENT DOCUMENTS

| | | | |
|---|---|---|---|
| 40026 | 3/1977 | Japan | 400/155 |

*Primary Examiner*—William Pieprz

*Attorney, Agent, or Firm*—Michael J. DeSha; David E. Pitchenik; Melvin J. Scolnick

[57] ABSTRACT

A voice coil motor assembly for a voice coil motor printwheel setting apparatus comprises a plate having the voice coil motor coils mounted thereon. The plate is adapted for attachment to a printed circuit board by pins electrically connected to the voice coils. Picker links having voice coil magnets connected thereto are stacked in sequence and the final assembly is completed by enshrouding the voice coil magnets with the voice coils mounted on the plate.

4 Claims, 5 Drawing Sheets

TO SOURCE CURRENT DRIVE (1ma)
8
260
+5V
SPRAGUE PNP TRANSISTOR ARRAY UDN-2983A
250A
250B
250C
250C
250E
250F
240A
240B
240C
240C
240D
240E
240F
200A
200B
200C
200D
200E
200F
200G
200H
200I
200J
200K
200L
210A
210B
210C
210D
210E
210F
210G
220A
220B
220C
220D
220E
220F
220G
+24V
+5V
230
SPRAGUE NPN TRANSISTOR ARRAY UDN-2003
8
TO SOURCE CURRENT DRIVE (1ma)

POSTAGE METER VOICE COIL MOTOR PRINTWHEEL SETTING ASSEMBLY

BACKGROUND OF THE INVENTION

This invention relates to postage meters and more particularly to printwheel and/or date setting mechanisms for postage meters.

Automatic selections of postage values from a keyboard has typically been accomplished in the past using either two methods. In one method, a first actuator positions a printwheel drive mechanism at each of several printwheels for individually setting each printwheel, normally by using a second actuator to position the digits of the printwheel. A typical example of an electronic mailing machine utilizing such an arrangement is described in U.S. Pat. No. 4,579,054 to Buan, et al., entitled STAND-ALONE ELECTRONIC MAILING MACHINE.

While such devices have worked well in conventional postage meters, there are disadvantages of such a selection method for setting a plurality of printwheels. The shift mechanism is extremely complex and creates problem in meeting the tolerances associated with the accurate positioning of the digit selector actuator and there can be problems in the mechanism hanging-up while shifting between printwheels. There is a further problem in high throughput applications because the time required to shift between multiple wheels limits the speed with which the postage meter can be set.

Postage meters using the second method provide parallel setting mechanisms for setting several printwheels at the same time. Such a postage meter is shown for example in U.S. Pat. No. 4,398,458. This patent also teaches a date-setting device utilizing the illustrated mechanism. In a design such as this, in addition to the costs associated with using more actuators, there is the physical problem associated with spacing of the comparatively large actuator mechanisms and proper alignment with closely spaced printwheels.

Such problems are particularly difficult in respect of printwheels for printing dates.

It is therefore an object of the invention to provide a small-volume, low-cost solution to the problem of fabrication for an assembly for providing a drive motor associated with each printwheel for printwheel setting.

SUMMARY OF THE INVENTION

In accordance with the invention, this and other objects are solved by apparatus comprising a voice coil motor and picker mechanism used to advance a castellated printwheel. The printwheel advances one pitch (one print element) of the printwheel per cycle of voice coil motor operation.

The assembly comprises a printwheel selection assembly comprising a plate, a plurality of voice coil motor coils mounted on said plate, a plurality of electrically conductive pins mounted on said plate and passing therethrough, said pins being adapted for electrical and mechanical connection to leads on a printed circuit board receiving said pins, said coils being electrically connected to respective pairs of said pins whereby said coils may be connected to receive electric circuit signals through said pins, a plurality of picker links connected by flexible links to respective voice coil motor magnets, and said voice coil motor coils receiving said voice coil magnets therein whereby the voice coil motor assembly for printwheel selection comprises a single package.

FIG. *7a* is a top view of the voice motor coil assembly.

FIG. *7b* is a side view of the same coil assembly.

FIG. *7c* is an end view of the same coil assembly.

Figure 8:
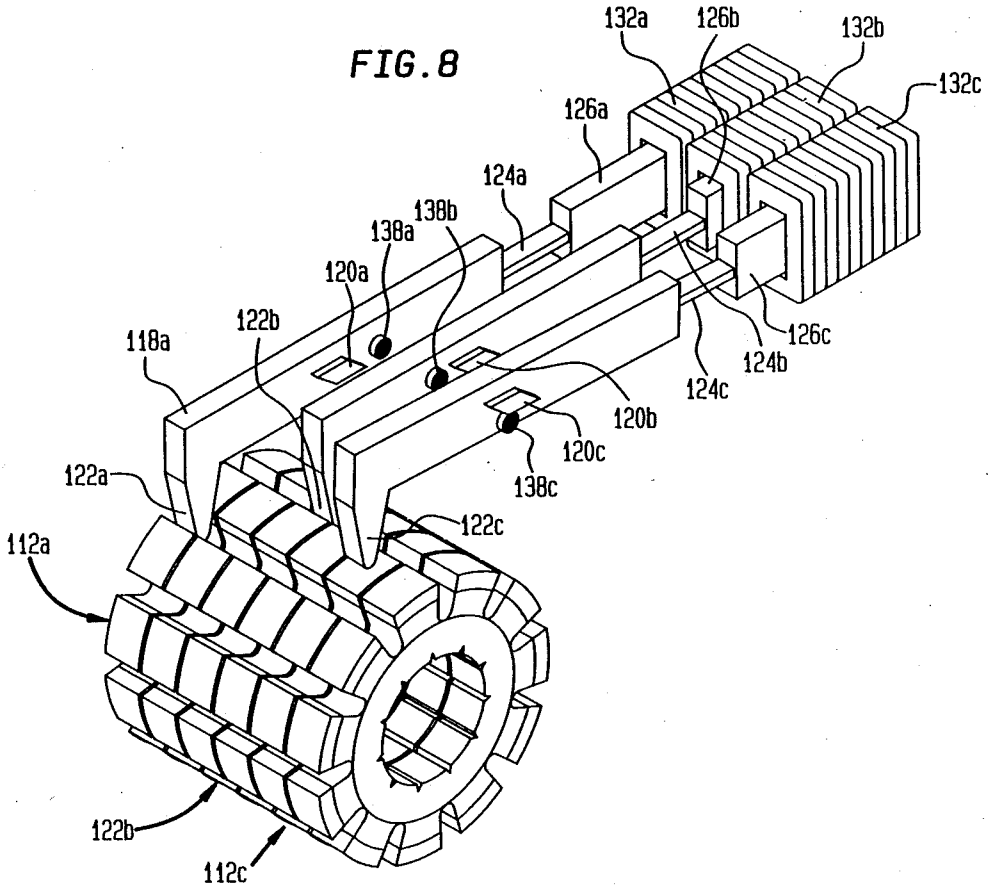

FIG. 8 shows a complete assembly for a plurality of printwheels.

Figure 9:
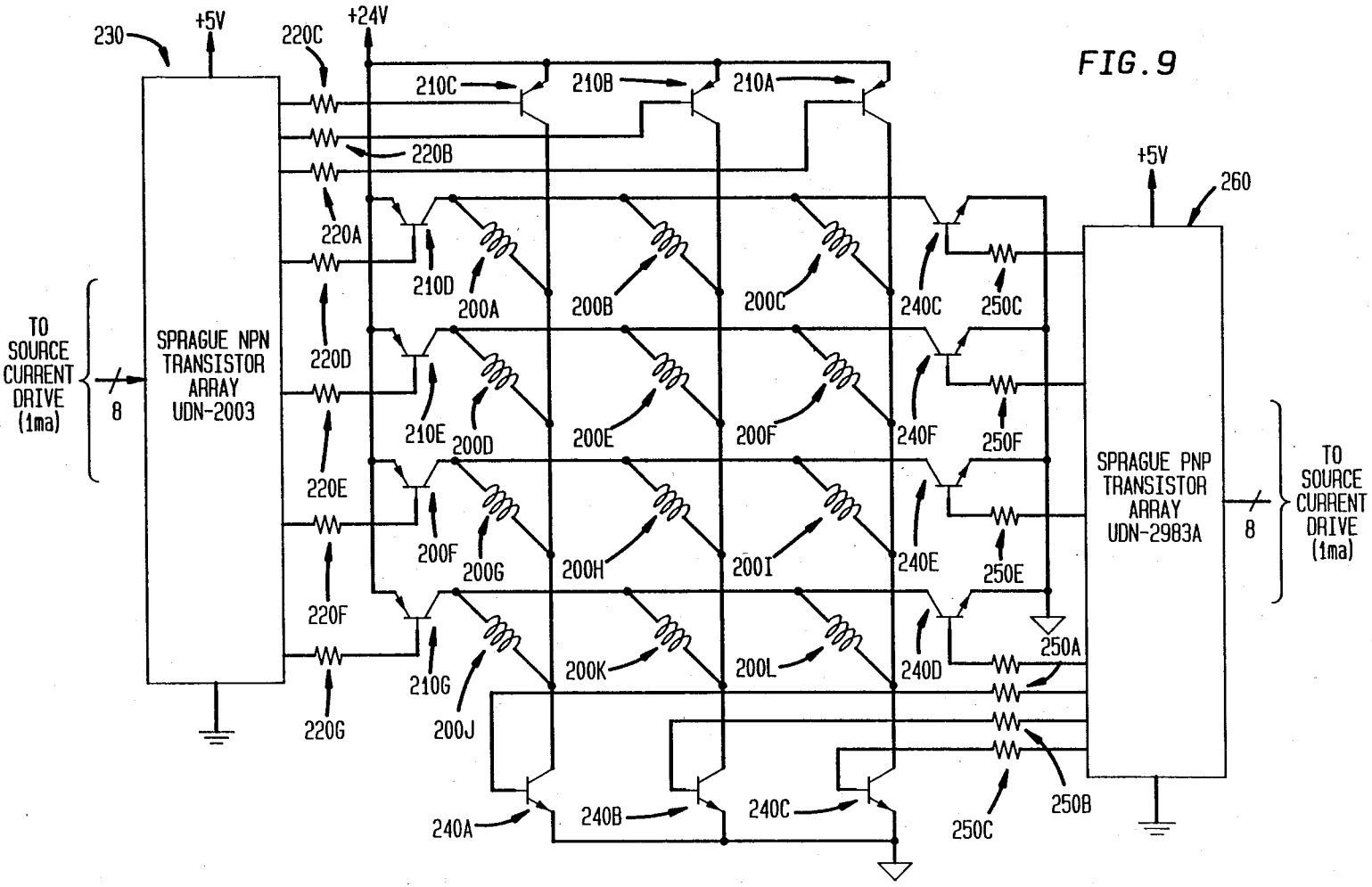

FIG. 9 shows a matrix switch for connecting drivers to the voice coil motors of the assembly.

DESCRIPTION OF THE PREFERRED EMBODIMENT

Figure 1:
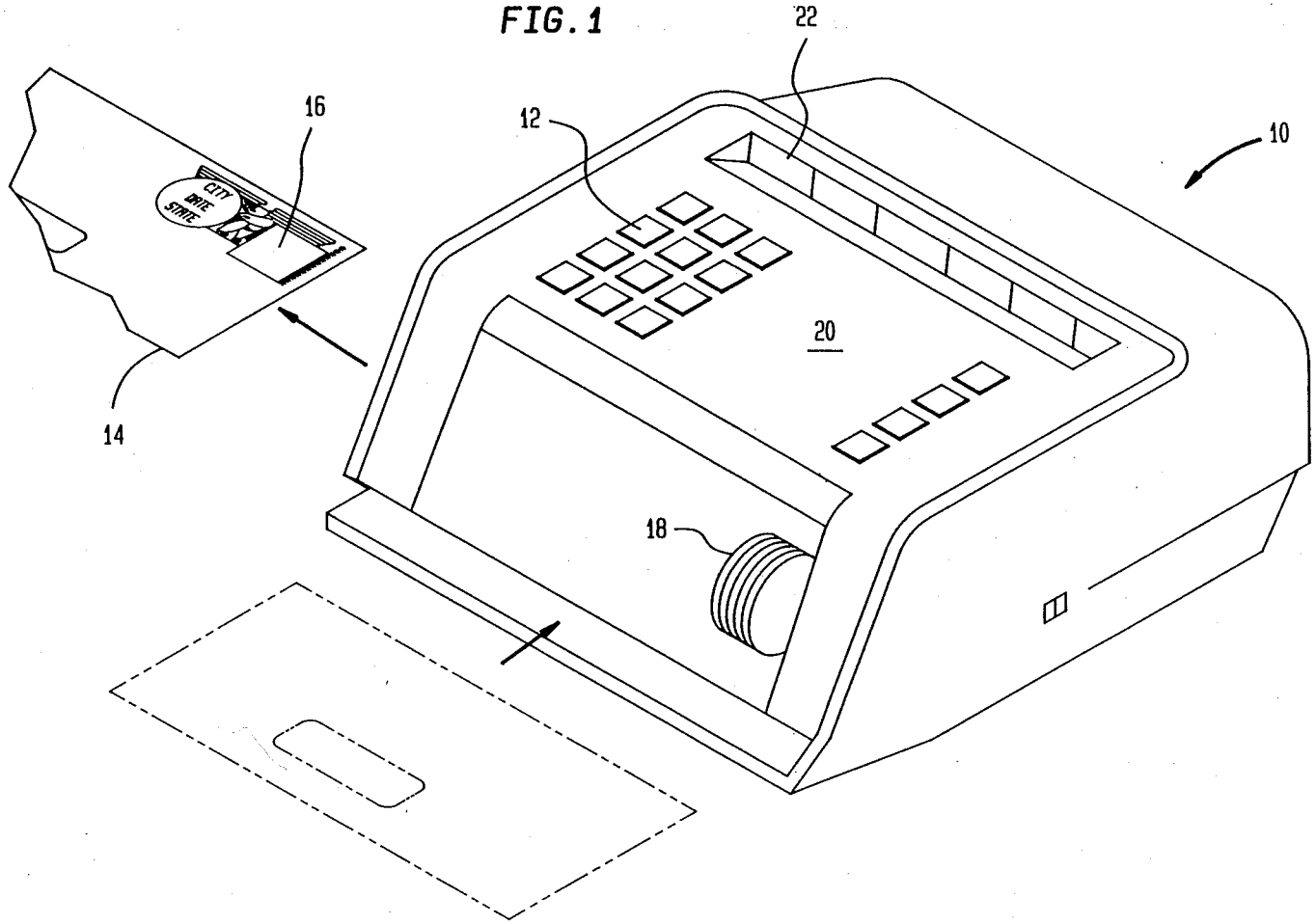
FIG. 1 shows a perspective view of a postage metering machine for producing an indicia.

Referring to FIG. 1, there is shown a postage meter 10 for printing postage indicia upon letter mail or the like. The meter 10 has the capability through an input keyboard 12 on the surface 20 for selection of postage value in accordance with operator requirements. A letter 14 imprinted with an indicia 16 is shown being ejected from the meter.

The meter 10 is shown and described in detail in U.S. Pat. No. 4,579,054 to Buan, et al. referred to previously and hereby specifically incorporated herein by reference. The selected postage is physically set on printwheels indicated schematically at 18 and is further displayed in display 22. Operation of the meter takes place under control of a microcomputer.

In the meter 10, the printwheels are set by means of a plurality of racks which engages gears affixed to the printwheels. The present invention is novel printwheel positioning assembly for setting the printwheels.

The postage meter shown at 10 further includes date printwheels which are manually positioned. It will be understood that the printwheel setting apparatus disclosed herein is suitable for setting such date printwheels. It should also be noted that the printwheel setting device taught herein is not limited to postage meters.

FIGS. 2–5 show in schematic form a wheel positioning assembly in accordance with the invention indicated in each Fig. at 100.

A castellated printwheel 112 having raised print elements 114 is shown mounted on shaft 116. It will be understood the printwheel shown may be one of a plurality of printwheels for printing of postal value as described in U.S. Pat. No. 4,579,054 to Buan, et al. previously incorporated herein by reference or they may also be printwheels whose print elements carry alphanumeric information. It will also be appreciated that the printwheels may be arranged for printing dates and that as many printwheels as are required may be positioned for rotation on shaft 116 and held in place by retainer such as spring clips (not shown).

Figure 2:
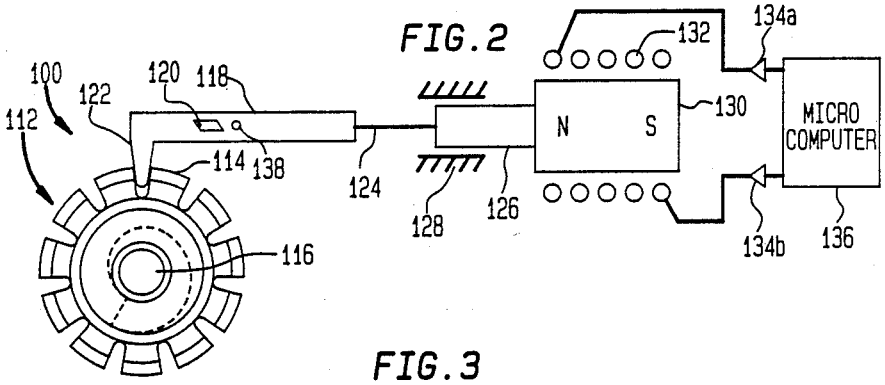
FIG. 2 shows in schematic form a printwheel selection assembly in accordance with the invention in its home position.

Picker link 118 having picker cam 120 affixed thereto is mounted for reciprocating movement between the positions indicated in FIGS. 2–5. In the home position as shown in FIG. 2, picker tooth 122 projecting from picket link 118 extends into the gap or slot between adjacent printwheel printing elements 114. Picker cam 120 is formed as a trapezoid and its function will be described below. It will be appreciated that, based on the discussion below, other forms of picker cams may be envisioned depending upon the desired path of the picker link.

It will also be understood that while the picker tooth 122 of the preferred embodiment engages the slot between the raised print elements 114, it is also contemplated that the picker tooth could engage slots between teeth on a gear affixed to the printwheel or slots appropriately spaced on a lateral extension of the printwheel surface adjacent to the printing surface.

Figure 6:
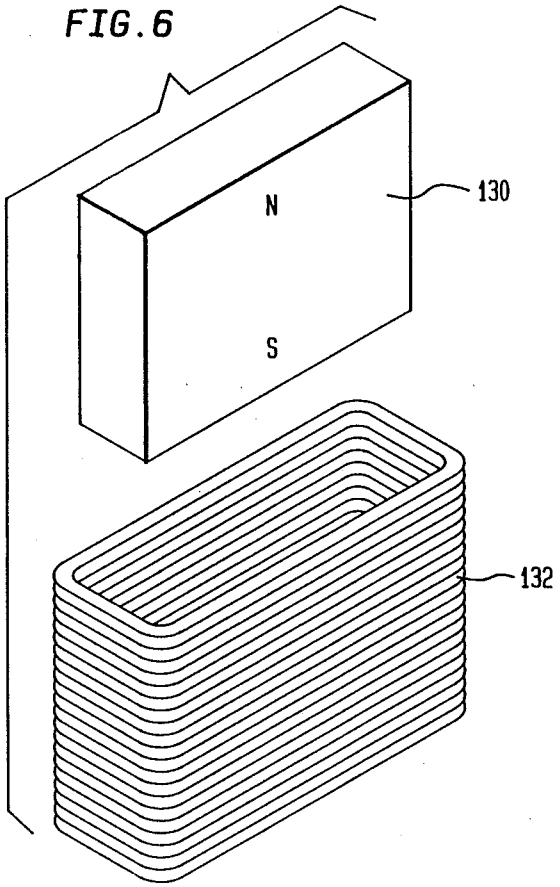
FIG. 6 shows a particular embodiment of the voice motor coil.

The picker link 118 is connected by flexible link 124 to member 126 which slidingly moves in guide 128. Member 126 is in turn affixed by suitable means to a magnet 130 positioned within wire coil 132. The construction of a preferred embodiment of the coil and magnet is best seen in FIG. 6. The magnet, coil and member sliding in the magnet guide together constitute a so-called voice coil motor, hereafter (VCM).

Preferably, the picker link 118, the flexible link 124, and member 126 are molded as single piece of plastic, or the like, in which the magnet is molded within an end portion. The flexible link 124 in this embodiment would be a necked-down segment which would provide sufficient support for the picker link segment 124 but would give the necessary flexibility in operation. Other means for supporting the picker link and for providing a flexible connection will occur to those skilled in the art.

The ends of the coil are connected to conventional drivers 134a and 134b which are controlled in a suitable manner conveniently under program control of microcomputer 136 to provide current flow in both directions through the coil 132.

As described below, the picker cam 120 cooperates with a cam stud 138 which is fixed to the frame of the postage meter (not shown), for example, and hence does not move relative to shaft 116.

Preferably, as best seen in FIG. 6, the coil is wound in a rectangular cross-section as illustrated to facilitate close spacing. It will be understood however, that other cross-sections may also be used as desired. The magnet 130 is fabricated to have a similar rectangular cross-section to fit inside the coil for the same reason. Typical dimensions of a magnet adequate for the application are shown in the figure. A suitable magnet is available from Indiana General designated at NEIGHT-27H. Suitably, the coil is wound with approximately 800 turns. To provide sufficient force, the coil draws approximately ½ amps at 24 volts.

In order to allow increased thickness of coil-magnet assembly, the voice coil assemblies can be conveniently alternated for adjacent wheels as shown in FIGS. *7a–7c*. Such an arrangement enables the coil thickness to be increased to twice the printwheel pitch.

As seen from FIGS. *7a–7c* and FIG. 8, the illustrated embodiment provides for ease of manufacturing and assembly. Preferably, the voice coils are assembled and bonded for example by gluing them onto the plate 140 containing pins 142 which protrude through the plate 140. The coil end wires are bonded to the pins 140 on the coil side of the plate. The plate may now be inserted to a printed circuit board 144 for connection to the coil electronic current drivers (not shown) in FIGS. *7a–7c* using the pins protruding through the opposite surface of the plate 140. The assembled plate having the coils and pins mounted thereon may thus be handled as a package for assembly purposes.

Further assembly then simply requires that the printwheels, magnet, and picket links be stack-assembled in layer cake fashion as indicated in FIG. 8. The plurality of magnets are then simply shrouded by the coils for final assembly as indicated in FIG. 8.

It should be noted that in the event that the printwheels are to be set in parallel, each VCM would require its own corresponding drivers as indicated in FIG. 2. Where the wheels may be sequentially set, a switch matrix as shown in FIG. 9 may be used.

FIG. 9 shows a voice coil matrix switching device suitable for driving an assembly of VCM's similar to those illustrated in FIG. 8. In FIG. 9, a plurality of coils 200A–200L (12 are shown) are disposed in an array. For operation, it is required that each coil be selectably disconnected, be connected with one end to +24V and the other to ground, and vice versa all under computer control.

Each end of coils 200A–200L is respectively connected to the collector of one of seven PNP power transistors 210A–210G suitably e.g. GED71Y1.5T1 power transistors. The emitters of these transistors 210A–210G are connected to a +24V power source. The bases of these transistors are connected through resistors 220A–200G to driver 230, suitably an NPN transistor array available from Sprague, Device No. UDN-2003. The driver 230 in turn receives input signals under control of the microcomputer on one of 8 lines and in turn provides the increased current necessary to switch the corresponding power transistor.

It will be noted that switching one of the power transistors 210A–210C provides 24 volts to one end of a bank of three or four coils 200A–200L depending on the particular transistor switched. The three transistors 210A–201C switch +24V to one end of the coils and the four remaining transistors 210D–210G switch the +24V to the opposite ends of the coils.

Similarly, each end of coils 200A–200L is respectively connected to the collector of one of seven NPN transistors 240A–240G suitably e.g. GED70Y1.5T1 power transistor. The emitters of these transistors are connected to ground and the bases are connected through resistors 250A–250G to driver 260, suitably a PNP transistor array available from Sprague, Device No. UDN-2983A. The driver 260, also receives input signals under control of the microcomputer on one of eight lines and provides increased current for switching the corresponding power transistor.

It will be seen that switching one of these power transistors places one end of a bank of three or four coils 200A–200L at ground. The three transistors 240A–240C connect one end of the coils to ground while transistors 240D–240G connect the other end of the coils to ground.

It will be understood that each of the power transistors includes a protection diode (not shown).

As an example of the operation, assume that it is desired that coil 200E by cycled. To accomplish this, transistor 210E is switched on to provide +24 volts to the top of the coil while transistor 240B is switched on in order to ground the opposite end of the coil 200E. It should be noted that even through 24 volts is applied to coils 200D and 200F as well as 200E, coil 200E is the only coil through which current will flow because it is the only coil that is grounded.

To complete the motor cycle, these transistors are switched off and transistors 210B and 240F are switched on. It will be seen that in this condition +24 volts is applied to the bottom of coil 200E through transistor 210B and the top of the coil is grounded through transistor 240F. Again, it will be seen that while 24 volts is applied to coils 200B, 200E, 200H, and 200K, the only complete circuit is made through 200E.

Turning again to FIGS. 2–5, the operation of the printwheel setting assembly in accordance with the invention will be described.

In operation, current is passed through the wire coil 132 by drivers 134*a* and 134*b* under control of microcomputer 136 or through the switching in a matrix array as described in connection with FIG. 9. For half the cycle of operation, current flow is in one direction. For the second half of the cycle, the current direction is reversed. It will be recognized that the polarized magnet 130 located within the wire coil 132 experiences a magnetic force due to the field accompanying the current flow through the coil. The force direction alternates with the current direction applied by the drivers. The magnet 130 accordingly reciprocates in a linear path centered within the wire coil 132 by the member 126 sliding within the magnet guide.

The picker link 118 having picket tooth 122 which causes the printwheel 112 to turn is connected to the magnet 130 by the flex link 124 to allow angular motion between the magnet 130 and picker link 118. The picket tooth 122 engages the gap between the raised elements 114 of printwheel 112 on the advance stroke but comes out of engagement with the wheel on the return stroke. This alternating engagement/disengagement is coupled to the linearly reciprocating motion of the magnet through the mutual action of the picker cam 120 and the cam stud 138 mounted on the frame.

Because of the trapezoidal shape of the picker cam 120 as seen in FIG. 2, as the picker link 18 is moved to the right by the VCM from the home position of FIG. 1, the cam stud 138 is contacted by the right side of cam 120 and the upper cam surface of cam 120 rides under stud 134 to force the picker tooth 122 into engagement with the raised element 114 and causes the wheel element 114 to be pulled toward the VCM to thereby turn the printwheel 12. The printwheel 112 continues to turn as the cam 120 passes under the cam stud.

Figure 3:
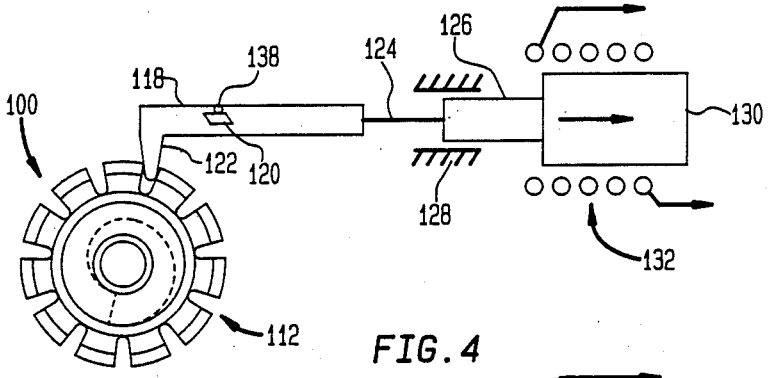
FIG. 3 shows the assembly of FIG. 1 in the wheel advancing position.
Figure 4:
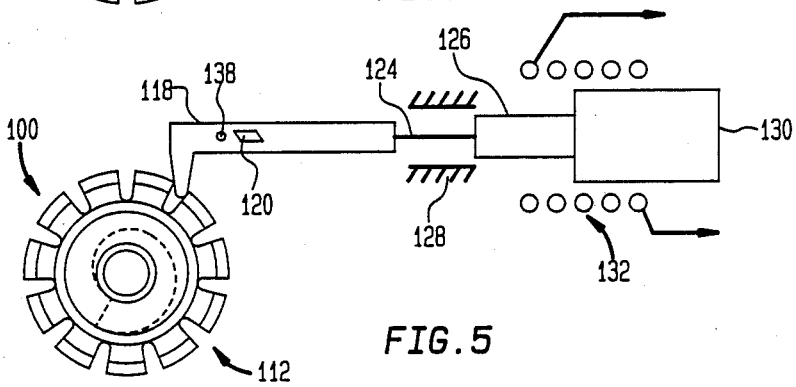
FIG. 4 shows the assembly at the end of the wheel advance.
Figure 5:
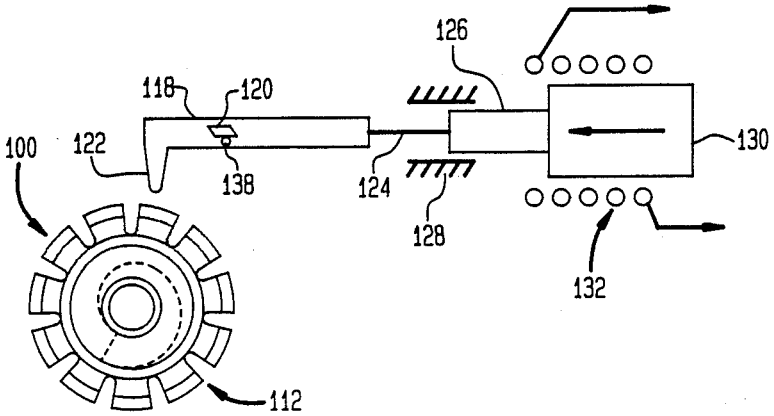
FIG. 5 shows the assembly as it is returning to its home position.
Figure 7C:
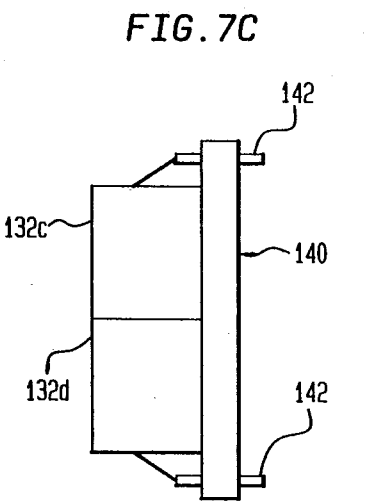
Figure 7A:
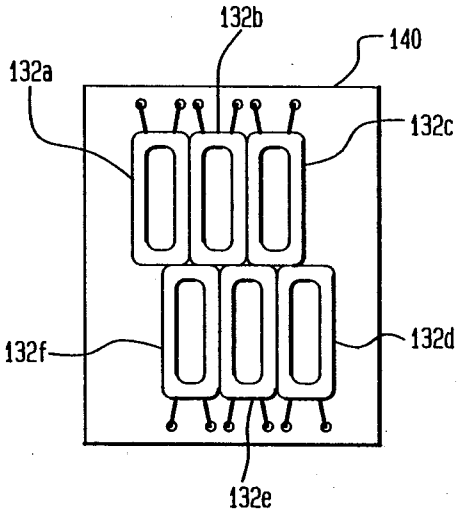
Figure 7B:
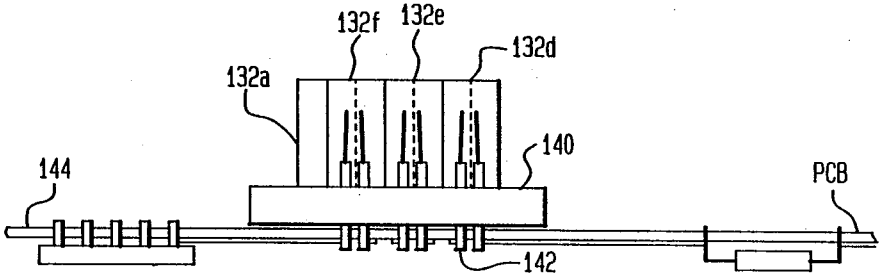

When the magnet 130 in the VCM reaches the end of its travel to the right, the coil current direction is reversed to reverse the direction of force acting on the magnet 130. The picker cam/cam stud relationship at this point is shown in FIG. 3. When the picker cam 120 slides off the cam stud 138, the flex link 124 connecting the magnet 130 to the picker link 118 causes the picker link to return to the condition where the upward cam surface of picker cam 120 is in line with the cam stud 138. As the picker link 118 is driven back to the left in the diagram, the leftward surface of cam 120 encounters the cam stud 138 causing the lower cam surface to ride over the stud 138 to cause the picker link 118 to flex upwards out of engagement with the printwheel as indicated in FIG. 4. In this way the printwheel is advanced one number pitch per cycle of voice coil motor operation.

This application incorporates certain material common to another application identified as Ser. No. 136,084, entitled POSTAGE METER PRINTWHEEL SETTING APPARATUS, filed on even date herewith. The subject matter of that application is incorporated herein by reference.

What is claimed is:

1. A printwheel selection assembly comprising:

a plate;

a plurality of voice coil motor coils mounted on said plate;

a plurality of electrically conductive pins mounted on said plate and passing therethrough;

said pins being adapted for electrical and mechanical connection to leads on a printed circuit board receiving said pins;

said coils being electrically connected to respective pairs of said pins whereby said coils may be connected to receive electric current from said printed circuit board through said pins;

a picker structure comprising a plurality of picker links each connected by one of a plurality of flexible links connected to respective ones of a plurality of voice coil motor magnets;

said voice coil motor coils each receiving and surrounding one of said voice coil magnets whereby the voice coil motor assembly for printwheel selection comprises a single package.

2. The assembly of claim 1 wherein said voice coil motor coils are of rectangular cross section.

3. The assembly of claim 2 wherein the coils are mounted in a staggered array.

4. The assembly of claim 1 wherein each of the respective picker links, flexible links, and magnets comprise a single piece having said magnet imbedded in an end portion thereof.

* * * * *